United States Patent [19]

Jehle et al.

[11] Patent Number: 4,939,523

[45] Date of Patent: Jul. 3, 1990

[54] AIRCRAFT RADAR ANTENNA

[75] Inventors: Franz Jehle; Eugen Arnold, both of Ulm; Erwin Woelfle, Risstissen, all of Fed. Rep. of Germany

[73] Assignee: Licentia Patent-Verwaltungs-GmbH

[21] Appl. No.: 195,978

[22] Filed: May 19, 1988

[30] Foreign Application Priority Data

May 20, 1987 [DE] Fed. Rep. of Germany ..... 3716585

[51] Int. Cl.[5] ..... H01Q 1/28

[52] U.S. Cl. ..... 343/705; 343/778

[58] Field of Search ..... 343/705, 777, 778

[56] References Cited

U.S. PATENT DOCUMENTS

| | | | |
|---|---|---|---|
| 3,308,468 | 3/1967 | Hannan | 343/777 |
| 3,355,738 | 11/1967 | Algeo | 343/779 |
| 4,150,378 | 4/1979 | Barton | 343/777 |
| 4,347,516 | 8/1982 | Shrekenhamer | 343/737 |

FOREIGN PATENT DOCUMENTS

| | | | |
|---|---|---|---|
| 2342882 | 5/1978 | Fed. Rep. of Germany | 343/785 |
| 3206517 | 9/1983 | Fed. Rep. of Germany | 343/782 |
| 0152102 | 7/1986 | Japan . | |
| 0265802 | 11/1987 | Japan . | |
| 0269503 | 11/1987 | Japan . | |

OTHER PUBLICATIONS

"Antenna Theory and Design", R. S. Elliott, 1981, Prentice-Hall, Inc.

*Primary Examiner*—Rolf Hille
*Assistant Examiner*—Doris J. Johnson
*Attorney, Agent, or Firm*—Spencer & Frank

[57] ABSTRACT

In an aircraft on-board radar system employing a sharply focused directional pattern which is able to sweep over a given space range, the range in the MPRF mode is limited primarily by the ground clutter picked up via the side lobes of the antenna pattern. To increase the range, an antenna is employed which, due to asymmetrical distribution of the antenna aperture (signal field) in the elevational direction with respect to the center of the aperture, has a significantly higher side lobe spacing below the principal lobe than above the principal lobe. Because of the side lobe spacing being greater below the principal lobe, less ground clutter components are picked up while the smaller side lobe spacing above the principal lobe results in hardly any increase of clutter components in the echo signal.

6 Claims, 2 Drawing Sheets

AIRCRAFT RADAR ANTENNA

BACKGROUND OF THE INVENTION

The invention relates to an aircraft radar antenna of the type having a directional pattern including a sharply focused principle lobe.

Modern aircraft pulse radar systems employ various pulse repetition frequencies (PRF) for target detection in the air-to-air operating modes. In the mode operating with a high PRF (HPRF), it is possible to unequivocally determine the velocity of a target, in the mode operating with a low PRF (LPRF) the distance of the target. The range in these operating modes is limited substantially by the average radiated HF power. In the mode operating with medium PRF (MPRF), target distance as well as target velocity can be determined but the result is ambiguous. The ambiguity can be resolved by changing the PRF and linking the results from measurements with different (medium) PRF's, e.g. according to the "Chinese remainder" method. In the mode operating with medium PRF, the range is limited primarily by ground clutter received by the antenna side lobes and is reduced, for example, compared to the HPRF mode which only furnishes the velocity of the target, by about 40%.

This loss of rang in the MPRF mode operation is particularly serious when considering the fact that the MPRF mode furnishes distance and velocity of the target in look-up and look-down situations under almost all target aspect angles.

SUMMARY OF THE INVENTION

It is therefore an object of the present invention to increase the range of such an aircraft on-board radar in the MPRF operating mode by reducing the influence of clutter.

This is accomplished by an aircraft radar antenna system including an antenna aperture and a radar antenna having a directional pattern with a sharply focused principal lobe for sweeping over a given space angle range, with an asymmetrical configuration distribution of the antenna aperture in the elevational direction wherein the configuration of the lower portion of the aperture below the center of the aperture results in a suppression of the side lobes of said antenna, and the directional pattern of the antenna signal exhibits side lobe radiation peaks spaced much farther apart below the radiation pattern of the principal lobe than above the radiation pattern of the principal lobe.

Due to the asymmetrical configuration of the side lobes of the antenna pattern or signal field, the echo signal exhibits a considerably reduced clutter component for an antenna according to the invention which otherwise has the same characteristics but a symmetrical aperture, (signal field) distribution and thus symmetrical side lobes so that weaker target echoes can still be detected and thus targets that are farther away can also be covered. While customarily a reduction in the side lobe level is connected with broadening of the principal lobe or an increase in antenna aperture, the invention takes advantage of the realization that with the same aperture and the same half-width of the principal lobe, the side lobes can be lowered on one side of the principal lobe if simultaneously an increase in the side lobe level on the other side of the principal lobe is provided. Since most of the clutter in an aircraft on-board radar originates from the ground, a reduction in the side lobe level below the principal lobe results in a noticeable reduction of ground clutter in the echo signal while the higher side lobes above the antenna do not result in noticeably higher clutter components. A difference in levels of at least 3 dB can here be considered the significant difference in side lobe spacing between the hemisphere or zone below the principal lobe and the hemisphere or zone above the principal lobe.

A multitude of possibilities are conceivable for the specific curve of the aperture distribution function. In particular, distribution optimized for the individual case can be determined, for example, experimentally or empirically by computer simulation. However, the person skilled in the art is also aware of analytical methods, for example, as disclosed by R. S. Elliott in "Antenna Theory and Design", Prentice Hall, 1981, and particularly Equation 5.69 of that publication where an asymmetrical aperture distribution is determined which will produce different side lobe levels. An example for this will be described below.

BRIEF DESCRIPTION OF THE DRAWINGS

The invention will be described in greater detail below with reference to the drawing figures.

It is shown in.

DETAILED DESCRIPTION OF THE PREFERRED EMBODIMENTS

Figure 1:
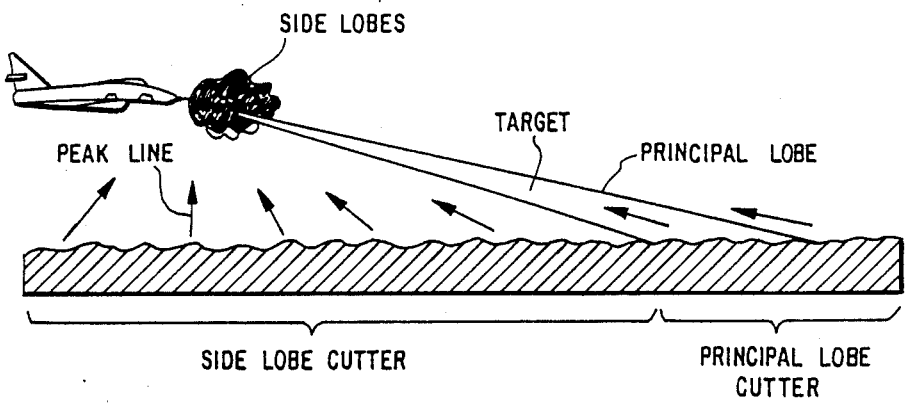
FIG. 1 is a side planer view of, an aircraft with downwardly oriented principal lobe (look-down situation)

In the situation sketched in FIG. 1, the principal lobe of the antenna directional pattern of the aircraft on-board radar system is oriented downwardly (look-down) and thus also covers the ground. By way of the sharply focused principal lobe of the antenna, echoes are thus received from the target (above ground) covered by the principal lobe as well as from a partial region on the ground (principal lobe clutter). At the same time, however, power is also radiated out and received over the side lobes of the antenna. The signals scattered back from the ground to the antenna (illustrated as arrows in FIG. 1) are for the most part received by way of the side lobes in the hemisphere below the principal lobe (side lobe clutter). Starting at the nose of the aircraft (location of the radar antenna), the sketch shows a conventional pattern with symmetrical side lobes as well as a pattern according to the invention with asymmetrical side lobes, the latter being hatched for the sake of distinction. Due to the side lobe level being clearly reduced in the lower hemisphere, the ground clutter level in the received signals is also reduced accordingly. The aircraft is drawn in a normal, horizontal flying position and this flying position is always assumed to exist herebelow. Relative location indications, such as above, below, elevational, always refer to the coordinate system of the aircraft itself. In particular, for example, the elevational direction of the antenna aperture should be understood to mean the direction lying in the aperture area of the antenna which, in the normal flying position of an aircraft, lies in a vertical plane passing through the longitudinal axis of the aircraft. The "azimuthal" phase distribution and pattern formation can be performed by prior art antennas and will therefore not be discussed in greater detail below.

Figure 2:
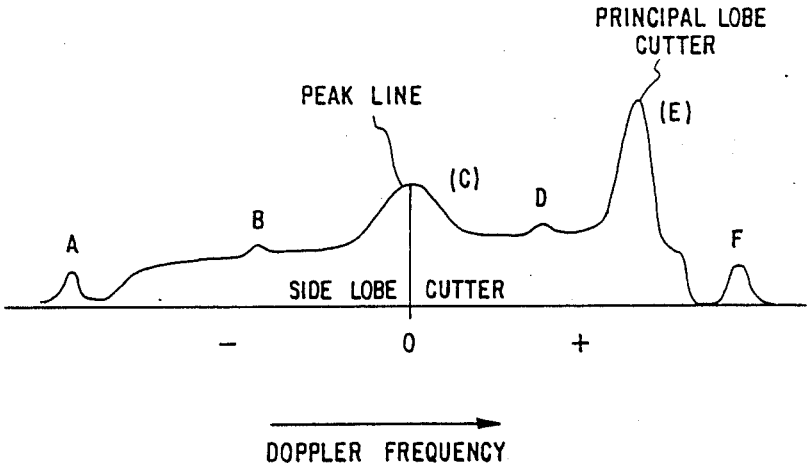
FIG. 2, a distribution of clutter and target echoes in the Doppler spectrum.

FIG. 2 shows the distribution of clutter and target echoes in the Doppler frequency spectrum of the echo signals. The side lobe clutter is spread out broadly corresponding to the very broad angle range from which ground clutter enters into the side lobes of the antenna. The side lobe clutter exhibits a maximum for a zero Doppler frequency which is identified as PEAK LINE. Superposed on the side lobe clutter is the principal lobe clutter which is high in amplitude and limited to a narrow Doppler frequency range according to the narrow principal lobe with high antenna gain. For the air target detected by the principal lobe of FIG. 1, the following situations regarding relative velocity with respect to the searching aircraft may be distinguished.

A: the target moves away at high velocity;

B: the target moves away at moderate relative velocity;

C: the target remains at approximately the same distance;

D: the target has an absolute velocity component in the same direction as the aircraft, but its distance decreases with moderate velocity;

E: the target is substantially stationary or moves transversely to the direction of flight of the aircraft;

F: the target has a significant absolute velocity component in the direction toward the aircraft, i.e. it approaches at high speed.

The target echoes for situations A and F lie outside the Doppler frequency range of the side lobe clutter and can therefore be detected even with a relatively high clutter level. Target echoes whose Doppler frequencies coincide with that of the principal lobe clutter (situation E) or with the PEAK LINE (situation C) can generally hardly be detected in the Doppler frequency spectrum because of the particularly high clutter level. Of significance for target detection are differences in clutter level, primarily for the broad Doppler frequency ranges of target situations B and D. This is where the invention provides significant improvements by reducing the clutter level. With the same discovery threshold for the signal/clutter ratio, the antenna according to the invention with its asymmetrical side lobes is still able to detect targets that are farther away or targets having a low back scatter cross section.

For example, for a reduction in side lobe level by 3 dB there already results an increase in range of 20% in the clutter-limited ranges of target situations B and D.

Figure 3A:
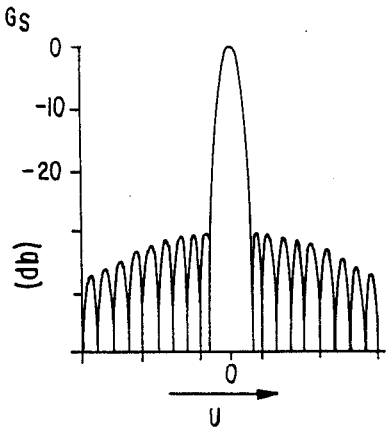
FIG. 3*a* is a representation of and FIG. 3*b* are, directional patterns including symmetrical and asymmetrical side lobes, respectively.
Figure 3B:
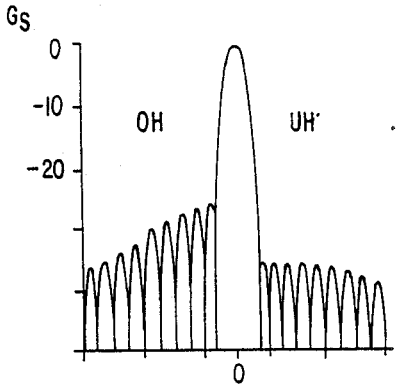
Figure 4A:
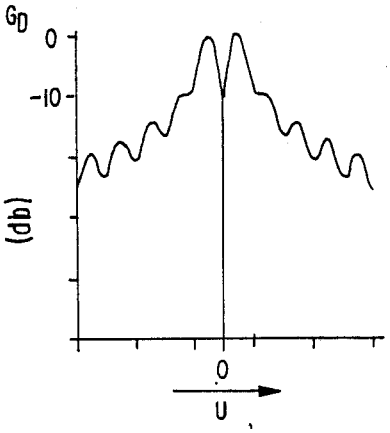
FIG. 4*a* and FIG. 4*b* are, associated difference diagrams for monopulse operation.
Figure 4B:
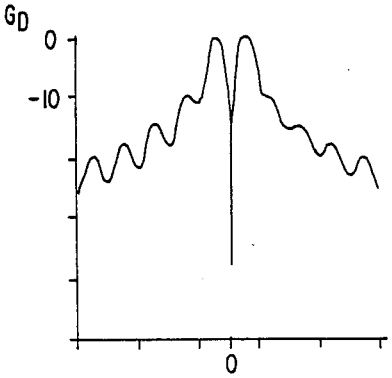
Figure 5A:
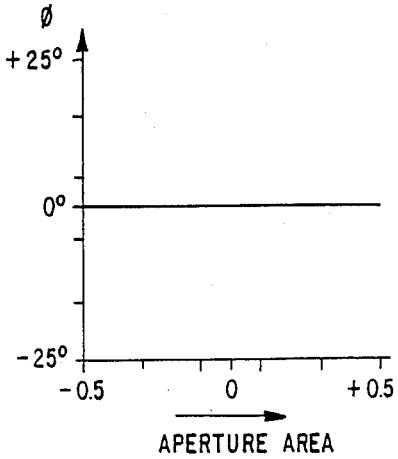
FIG. 5*a* and FIG. 5*b* are, phase distributions of the aperture forming the bases of FIGS. 3 and 4.

FIGS. 3, 4 and 5 show a comparison of a concrete example of an antenna with asymmetrical side lobe behavior (right column of the figure), with the case of the same antenna with symmetrical side lobes (left column of the figure). It is here assumed that the antenna is able to produce not only a sharply focused directional pattern having clearly spaced side lobes (FIGS. 3*a*, 3*b*) but simultaneously also a monopulse difference diagram (FIGS. 4*a*, 4*b*). It is assumed that the antenna aperture is a planar rectangular surface. To describe the antenna in space, an orthogonal cartesian coordinate system (x, y, z) is assumed to be employed with its coordinate origin lying in the center of the aperture, and its sides parallel to the x and y axes, respectively, while its surface is oriented normal to z direction. The cartesian coordinates can be converted in a known manner to spherical coordinates, retaining the axis orientations. The space region of interest in the positive z direction can then be subdivided into a lower hemisphere UH where $x \leqq 0$ and $90° \leqq \phi \leqq 270°$, $0° \leqq \theta \leqq 90°$ and an upper hemisphere OH where $x > 0$ and $-90° < \phi < +90°$, $0° \leqq \phi \leqq 90°$. The distribution function B(x, y) of the antenna aperture can be linked with the radiation pattern S(u, v) by means of a Fourier transformation, with u and v resulting from the provided coordinate system according to the following equations:

$$u = \frac{\text{aperture length in the } x \text{ direction}}{\text{wavelength}} \cdot \sin\theta \cos\phi$$

$$v = \frac{\text{aperture length in the } y \text{ direction}}{\text{wavelength}} \cdot \sin\theta \sin\phi$$

If the distribution function B(x, y) can be separated, i.e. $B(x, y) = B(x) \cdot B(y)$, S(u, v) can also be separated into $S(u, v) = S_u(u) \cdot S_v(v)$, thus considerably simplifying the analytic derivation. The aperture is assumed to be illuminated according to the function $B(x, y) = T(x)$, where T(x) is a modified Taylor distribution. B(x, y) is assumed to be independent of coordinate y.

According to Equation 5.69 of Elliot, the radiation pattern S(u, v) then results as follows:

$$S(u,v) = \text{constant} \cdot \frac{\sin \pi \cdot u}{\pi \cdot u} \cdot \frac{\frac{\pi}{n}\left(1 - \frac{u_n}{n}\right)}{\frac{\pi}{n}\left(1 - \frac{u}{n}\right)} \cdot \frac{\sin \pi \cdot v}{\pi \cdot v}$$

Two whole-number values $n_R$ and $n_L$ ($n_R$, $n_L > 1$) as well as a side lobe attenuation $SL_R$ for the lower hemisphere and $SL_L$ for the upper hemisphere can be given as the pattern forming parameters which thus determine the distribution. The values $n_L$ and $n_R$ determine the counting range for the running variable n of the products $\pi$ in such a manner that a product is formed for $-(n_L - 1) \leqq n \leqq (n_R - 1)$, $n \leqq 0$. The value $u_n$ implicitly includes, in addition to the running number n, the values $n_R$ and $SL_R$ for $n > 0$ and $n_L$ and $SL_L$ for $n < 0$, respectively. By giving values for $n_R$, $n_L$, $SL_R$ and $SL_L$, the radiation pattern is fixed; in particular, a symmetrical pattern results for $n_R = n_L$ and $SL_R = SL_L$, and an asymmetrical pattern for $n_R \neq n_L$ and $SL_R \neq SL_L$.

The distribution function B(x, y) which produces pattern S(u, v), is obtained by Fourier transformation of S(u, v) toward u and v. B(x, y) is constant over the aperture area. Since the characteristics of a steady distribution can be transferred to a discrete distribution, if the spaces between the individual radiators of the discrete distribution are not too large, FIGS. 3, 4 and 5 also apply for corresponding array antennas. With array antennas it is customary to call S(u, v) the group factor and write G(u, v) instead.

The amplitudes of the illuminations of FIGS. 3*a* and 3*b* are not given here. They are both symmetrical to the line $x = 0$ and almost identical. The phases $\phi$ of the illuminations are plotted in FIGS. 5*a* and 5*b* over the standardized x coordinate of the aperture area (−0.5 corresponds to the start of the aperture, 0 corresponds to the center of the aperture, 0.5 corresponds to the end of the aperture). Above this are shown the respective group factors for the associated sum diagrams $G_S$ and the difference diagrams $G_D$ as a function of u with a constant v.

The symmetrical sum diagram of FIG. 3*a* shows a sharply focused principal lobe and the same side lobe spacing of about 30 dB for the upper hemisphere OH and for the lower hemisphere UH. The associated difference diagram of FIG. 4*a* has a distinct minimum at the location of the main beam direction of the sum diagram. The phase of the illumination is constant over the entire aperture.

Figure 5B:
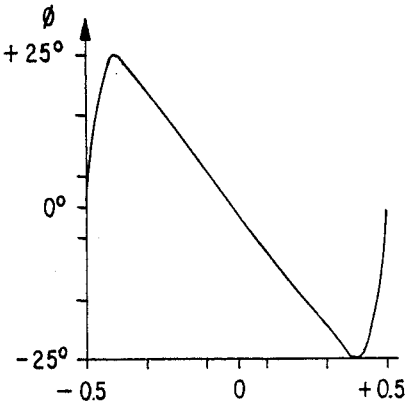

In comparison thereto, the phase distribution to obtain the asymmetric pattern results, according to the above derivation, in a non-linear phase distribution curve which is anti-symmetrical with respect to the center of the aperture for the aperture of FIG. 5*b*. The maximum phase deviations of ±25° are slight. For antenna arrays operating with electronic sweep, these phase deviations from a homogeneous distribution could be considered in the actuation of the individual phase shifters. With mechanically pivoted antennas having a fixed phase distribution, such as, for example, slot radiator antenna arrays, the asymmetrical phase distribution is considered already in the construction of the antenna in that, for example, the individual slot radiators are not equidistant as for homogeneous distribution but are provided in the waveguide with a corresponding local deviation.

The sum diagram produced with such an anti-symmetrical phase distribution is shown in FIG. 3*b*. The sharply focused principal lobe has the same halfwidth as in the diagram of FIG. 3*a*. However, the side lobes for the lower hemisphere have a maximum level of −35 dB and are thus about 5 dB lower than in the symmetrical pattern. The side lobe level in the upper hemisphere, however, reaches roughly −25 dB and is thus about 5 dB higher than in the symmetrical pattern and 10 dB higher than the side lobe level in th lower hemisphere. The associated difference diagram of FIG. 4*b* again shows a deep cut in the pattern which occurs at the same space angle as the maximum in the sum diagram of FIG. 3*b*.

Since the halfwidths as well as the antenna gains are the same in both sum diagrams of FIGS. 3*a* and 3*b* and the low minimum for both difference diagrams coincides in space with the main beam direction of the associated sum diagram, the two different phase distributions result in antenna patterns having the same good characteristics in the main beam direction. However, regarding the side lobes and the ground clutter component in the echo signal, the asymmetric diagram of FIG. 3*b* obtained with the asymmetric phase distribution of FIG. 5*b* is clearly superior to the symmetrical pattern for an aircraft on-board radar system.

Another possibility for determining aperture distribution described in the above-mentioned book by Elliott is an iterative procedure. Additionally, as already mentioned, it is also possible to determine the aperture distribution empirically, for example by means of computer simulation of an aperture distribution which results in the asymmetric pattern according to the invention.

We claim:

1. An aircraft radar antenna system including an antenna aperture and a radar antenna having a directional pattern and including a sharply focused principal lobe for sweeping over a given space angle range to detect a target, and a side lobe pattern having a first zone above and a second zone below the principal lobe, the improvement comprising:

means for reducing the signal strength of side lobes within said second zone for producing an asymmetrical configuration of the antenna signal field in the elevational direction wherein the configuration of the second zone with respect to the first zone results in the directional pattern of the antenna signal exhibiting side lobe radiation peaks spaced much farther apart below the radiation pattern of the principal lobe than above the radiation pattern of the principal lobe thereby reducing the effect of non-target induced reflections.

2. Antenna according to claim 1, characterized in that the amplitude distribution of the signal field is symmetrical, the phase distribution is non-linear and anti-symmetrical with respect to the center of the aperture.

3. Antenna according to claim 1, characterized in that the antenna is configured as a mechanically pivoted antenna with a fixed, given signal field distribution.

4. Antenna according to claim 1, characterized in that the antenna is configured as a stationary antenna with electronic sweep.

5. An antenna system according to claim 1, wherein said signal strength reducing means includes means for producing a non-linear phase distribution curve which is asymmetrical with respect to the center of the signal field.

6. An antenna system according to claim 1, wherein said signal strength reducing means includes a slot radiator array having a plurality of slot radiators which are non-homogeneously distributed across the antenna signal field.

* * * * *